US007207807B2

(12) United States Patent
Fogg

(10) Patent No.: US 7,207,807 B2
(45) Date of Patent: Apr. 24, 2007

(54) NOISE CANCELING DIFFERENTIAL CONNECTOR AND FOOTPRINT

(75) Inventor: Michael W. Fogg, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/002,379

(22) Filed: Dec. 2, 2004

(65) Prior Publication Data

US 2006/0121749 A1 Jun. 8, 2006

(51) Int. Cl.
*H01R 12/00* (2006.01)

(52) U.S. Cl. ..... 439/65

(58) Field of Classification Search ..... 439/676, 439/941

See application file for complete search history.

(56) References Cited

U.S. PATENT DOCUMENTS 6,083,047 A 7/2000 Paagman
6,116,965 A 9/2000 Arnett et al. ..... 439/692
6,310,286 B1 10/2001 Troxel et al.
6,461,202 B2 10/2002 Kline
6,551,140 B2 4/2003 Billman et al.
6,682,368 B2 1/2004 Murr et al.
6,695,646 B1 2/2004 Grabbe
6,705,895 B2 3/2004 Hasircoglu
6,739,910 B1 5/2004 Wu
6,743,057 B2 6/2004 Davis et al.
6,932,655 B2 * 8/2005 Hatterscheid et al. ..... 439/676
2003/0064614 A1 4/2003 Tanaka et al.
2003/0082954 A1 5/2003 Espenshade et al.
2004/0174223 A1 9/2004 Achyut

FOREIGN PATENT DOCUMENTS

EP 0459356 B1 8/1995

* cited by examiner

*Primary Examiner*—Briggitte R. Hammond

(57) ABSTRACT

An electrical connector is provided that includes a housing having a mating interface. Contacts provided in the housing are organized in differential pairs with the contacts in each of the differential pairs being located along an associated differential pair contact line. The differential pairs are aligned wherein the differential pair contact lines of adjacent differential pairs are non-parallel to one another.

20 Claims, 3 Drawing Sheets

NOISE CANCELING DIFFERENTIAL CONNECTOR AND FOOTPRINT

BACKGROUND OF THE INVENTION

This invention relates generally to electrical connectors and more particularly, to differential pair electrical connectors.

A variety of connectors exist today for use in differential pair applications. In differential pair applications, a signal is divided in half (each half being the inverse of the other half) and each half is transmitted over a separate data line to a mating interface of a connector. The mating interface of an electrical connector may have a plurality of contacts, and in differential pair applications, the contacts are generally organized into differential pairs. The signal quality of a differential pair of contacts may be reduced due to cross talk/noise and the like caused by electromagnetic fields (EMFs) created by nearby differential pairs of contacts. The structure and configuration of an electrical connector affects the cross talk aspects of the electrical connector. The electronics industry has offered various solutions for improving the quality of differential signals at the mating interface for an electrical connector.

One approach involves arranging ground shields within the connector to reduce the EMF interference on a differential pair of connectors from nearby differential pairs. When mating the header and receptacle connectors, the ground shields make contact before the signal contacts engage one another. In certain connectors, the shape of the receiving chamber is matched to the shape of the electrical contact being received so as to reduce the air gap therebetween, thus reducing the impedance of the terminal contact, and thereby improving signal performance.

Supplying ground shields and planes within the configuration of the connector provides one approach to reducing the EMF interference on differential pairs. However, the addition of numerous ground shields may increase the cost of the connector. Furthermore, the footprint or size of the electrical connector may increase with the addition of ground contacts and shields. Moreover, as the data rate increases, the electrical connector may need to reduce further the EMF interference.

A need still exists for further reduction of the cross talk/noise in differential pair connectors that are used in high speed data connections.

BRIEF DESCRIPTION OF THE INVENTION

An electrical connector is provided that includes a housing having a mating interface. Contacts provided in the housing are organized in differential pairs with the contacts in each of the differential pairs being located along an associated differential pair contact line. The differential pairs are aligned in a row wherein the adjacent differential pairs in the row have different orientations from one another.

An electrical connector is provided that includes a housing having a mating interface. Contacts provided in the housing are organized in differential pairs with the contacts in each of the differential pairs being located along an associated differential pair contact line. The differential pairs are aligned in rows and columns. The adjacent differential pairs in the rows have different orientations from one another, and the adjacent differential pairs in the columns have different orientations from one another.

DETAILED DESCRIPTION OF THE INVENTION

Figure 1:
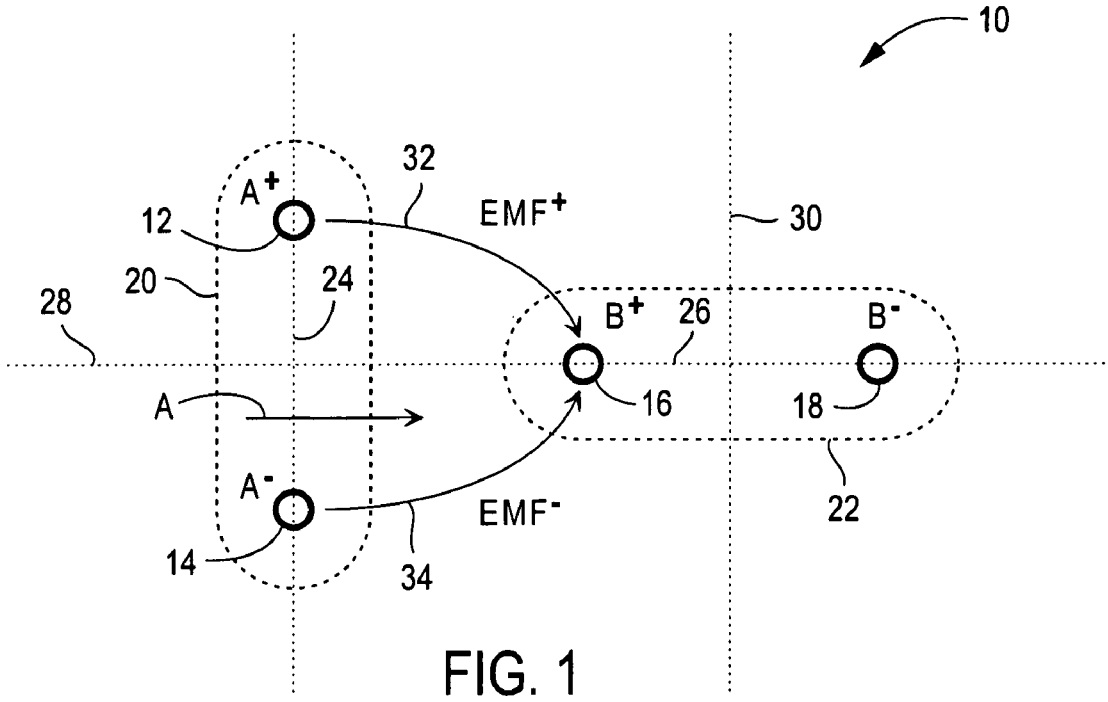
FIG. 1 is a top view diagram of a contact pattern of an electrical connector formed in accordance with an embodiment of the present invention.

FIG. 1 illustrates a contact pattern 10 of an electrical connector formed in accordance with an embodiment of the present invention. The contact pattern 10 is oriented to reduce the cross talk/noise of plated through-holes in the electrical connector. Contact pattern 10 shows four contacts 12, 14, 16, and 18, which may be included in a mating interface of a housing of an electrical connector. FIG. 1 illustrates a differential pair 20 and a differential pair 22 arranged orthogonal to one another. The differential pair 20 includes the contacts 12 and 14 that are configured to carry differential signal "A". The differential signal "A" is comprised of an "A+" component (contact 12) and an "A−" component (contact 14), each component an inverse of the other. Likewise, the differential pair 22 includes the contacts 16 and 18 that are configured to carry a differential signal "B". The differential signal "B" is comprised of a "B+" component (contact 16) and a "B−" component (contact 18), each component an inverse of the other. The contacts 12 and 14 of the differential pair 20 are configured orthogonal to the contacts 16 and 18 of the differential pair 22.

The differential pairs 20 and 22 are positioned adjacent to one another and form a row in the direction of an arrow A, as shown in FIG. 1. A contact line 24 is defined by drawing a line through the contacts 12 and 14. Similarly, another contact line 26 may be drawn through the contacts 16 and 18. The contacts 12 and 14 are separated from one another and located on opposite sides of a bisector axis 28. The contacts 16 and 18 are separated from one another and located on opposite sides of a bisector axis 30. The contact line 24 has an orientation different from the contact line 26.

The bisector axis 28 is oriented perpendicular to the contact line 24 and coincides with the contact line 26. Since the contacts 16 and 18 lie along the contact line 26, which is the perpendicular bisector of the contact line 24, the contact 16 is equidistant from the contacts 12 and 14 and, likewise, the contact 18 is equidistant from the contacts 12 and 14. The bisector axis 30 is perpendicular to the contact line 26. The differential pairs 20 and 22 are configured such that their corresponding contact lines 24 and 26 are perpendicular to one another and one contact line (e.g. 26) overlays the perpendicular bisector of the other contact line (e.g. 24).

In operation, differential signals passing through the differential pairs 20 and 22 form EMF. The contact 16 is in the presence of an electromagnetic field (EMF+) 32 that is generated by the contact 12. The contact 16 is also in the presence of an electromagnetic field (EMF−) 34 that is generated by the contact 14. Because the contacts 12 and 14 form the differential pair 20 with equal and opposite (inverse) signals and because the contact 16 is equidistant from the contacts 12 and 14, the EMF 32 cancels the EMF 34 at the contact 16. The net effect of the EMF 32 and the EMF 34 at the contact 16 is zero. Similarly, the net effect of the EMF 32 and the EMF 34 at the contact 18 is zero too. The cross talk/noise generated at the contact 16 due to EMF 32 and 34 created by the contacts 12 and 14 is self canceling with the net effect on the signal component carried at the contact 16 being zero. In the embodiment of FIG. 1, the contacts 12, 14, 16, and 18 are illustrated as pin type contacts. Optionally, the shape of the contact may be other than a pin, such as an 'x', a blade, a contact pad, a cross, a star, and the like.

Figure 2:
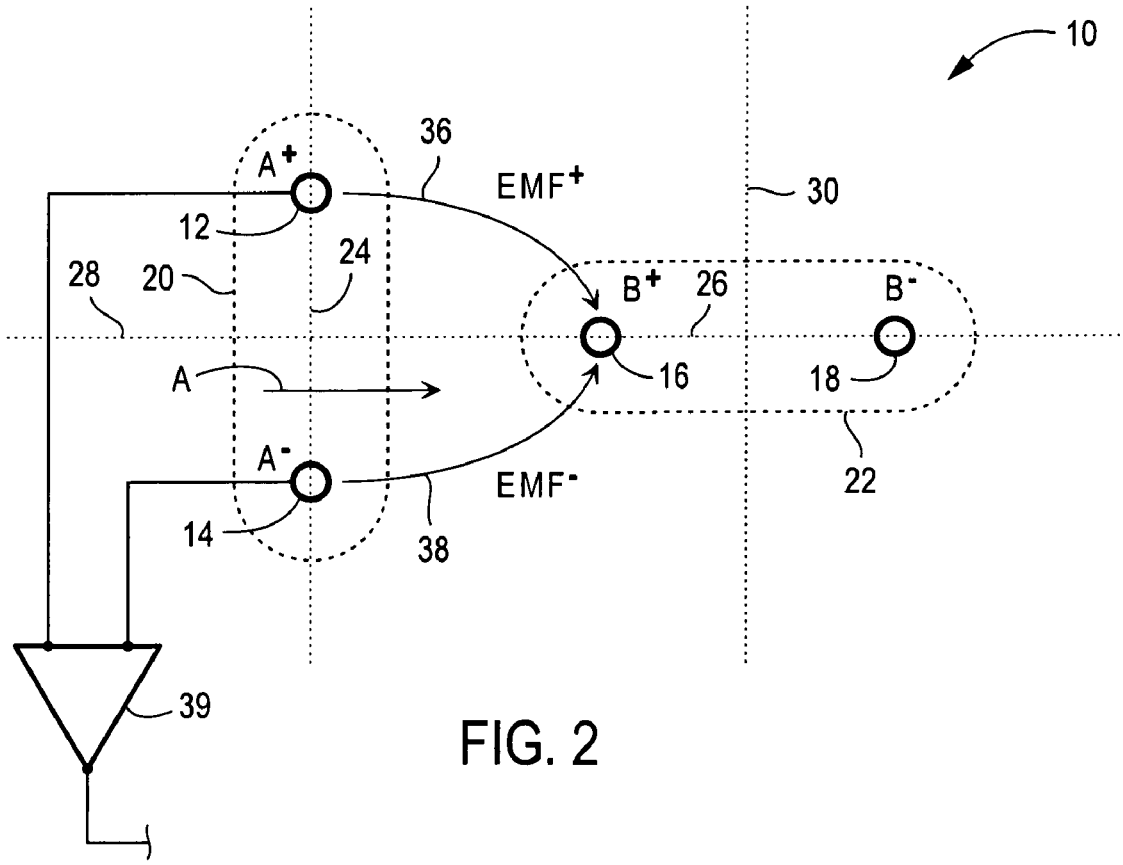
FIG. 2 is a top view diagram of the contact pattern of FIG. 1 joined to a common mode differential receiver.

FIG. 2 illustrates the contact pattern 10 of FIG. 1 joined to a common mode differential receiver 39. In operation, the contact 16 generates an EMF 36 at the contact 12 and an EMF 38 at the contact 14. The contact 16 is equidistant from the contacts 12 and 14, and thus the coupling of the contact 12 due to EMF 36 is equal and in phase with the coupling of the contact 14 due to EMF 38. The differential receiver 39 amplifies the difference in the two signals carried at contacts 12 and 14. Since the EMF energy experienced at the contact 12 and at the contact 14 due to the contact 16 is equal and in phase, the signal effects are also equal and thus are eliminated by the differential receiver 39. The differential receiver 39 compares signals received at its inputs and outputs a signal representative of the difference therebetween. Signal components that are common to both input lines of the differential receiver 39 are rejected and not output therefrom. Common mode (equal and in phase energy) detection by the differential receiver 39 for differential pair 20 eliminates equal and in phase signal components from each of the contacts 12 and 14, only amplifying the difference in the signal components "A+" and "A−", e.g. ["A+"+noise]−["A−"+noise]=2A. The net effect at the differential receiver "A" of cross talk/noise (EMF effects) from contact 16 is zero.

Figure 3:
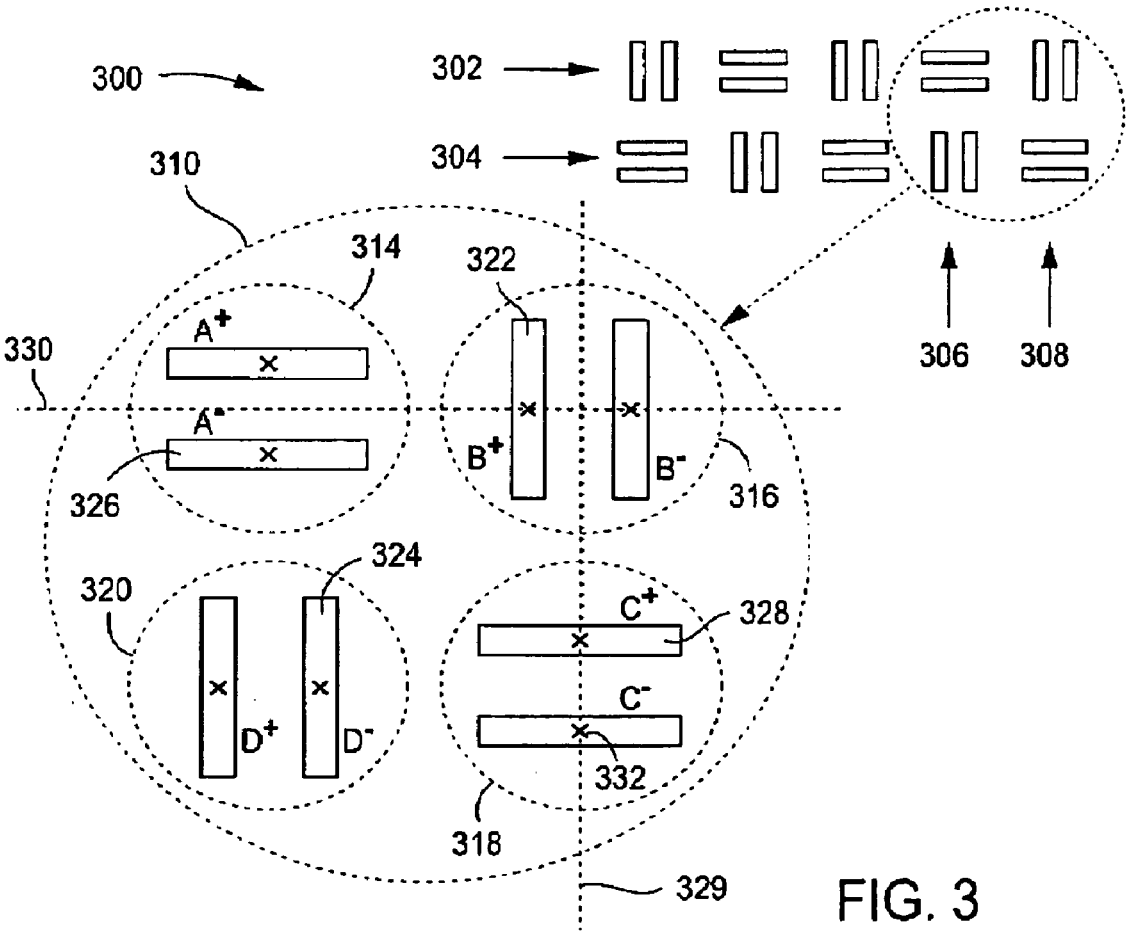
FIG. 3 is a top view of a blade contact pattern illustrating rows and columns of electrical connector contacts in accordance with an embodiment of the present invention.

FIG. 3 illustrates a footprint 300 of blade contacts 322, 324, 326 and 328 formed in accordance with an alternative embodiment. The contacts 324 and 326 are configured in rows 302 and 304 and columns 306 and 308. A set of four nearest neighbors 310, is enlarged to show differential pairs 314, 316, 318, and 320. Adjacent differential pairs in the four nearest neighbors 310 are aligned orthogonal to one another. In the example, the differential pair 314 is orthogonal to the differential pairs 316 and 320. The differential pair 316 is orthogonal to the differential pairs 314 and 318. The differential pair 318 is orthogonal to the differential pairs 316 and 320. The differential pair 320 is orthogonal to the differential pairs 314 and 318.

The contacts 322–328 of FIG. 3 include blades at the mating interface, the blades having a length (longitudinal direction) and a width (transverse direction) such that the length is greater than the width. The blades of a differential pair are oriented with the transverse direction extending parallel to an associated differential pair contact line (see, for example, contact line 329 of the differential pair 318, and contact line 330 of the differential pair 316). The blades include contact axes 332. In FIG. 3, any two adjacent differential pairs (not on a diagonal, but in a row or column to each other) have contact lines that are perpendicular with one another.

In operation, the unique structure of footprint 300 shown in FIG. 3 relies on the symmetrical properties of a differential signal to reduce the noise in an electrical connector or transmission line. The footprint 300 alternates the orientation of adjacent differential pairs such that a differential pair is located in an orthogonal direction to an adjacent differential pair. In the example of FIG. 3, no ground contacts are included.

Figure 4:
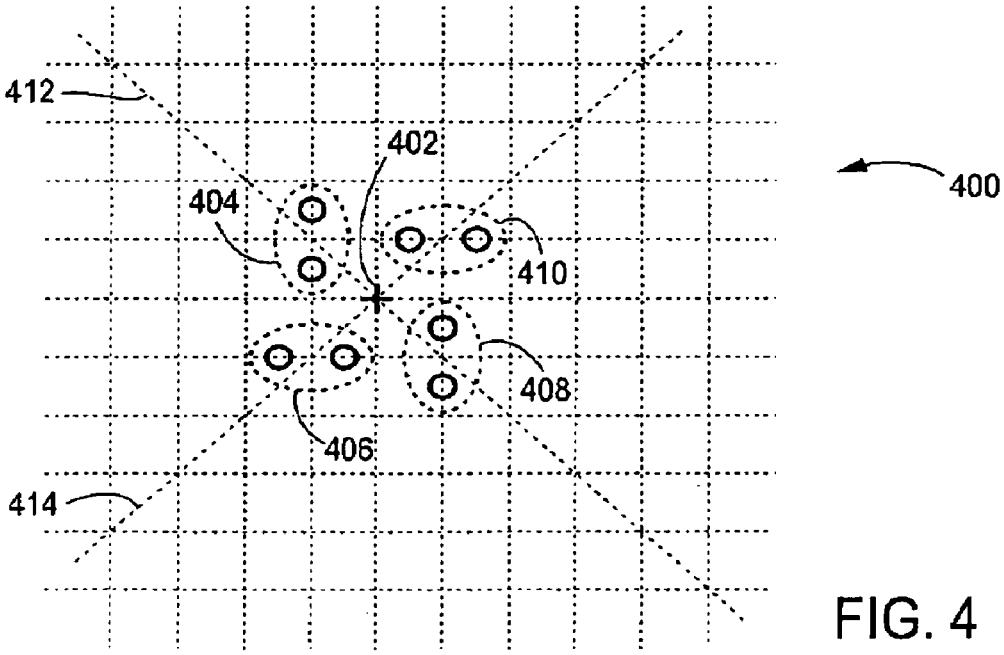
FIG. 4 is a top view of a contact pattern formed in accordance with an embodiment of the present invention that utilizes a contact ground.

FIG. 4 illustrates an alternative embodiment of four nearest neighbors within a footprint 400. A ground contact 402 is centered with respect to four adjacent and orthogonal differential pairs 404, 406, 408, and 410 of the footprint 400. The ground contact 402 is centrally positioned at the intersection of a diagonal axis 412 extending between the differential pairs 404 and 408, and a diagonal axis 414 extending between the differential pairs 406 and 410. The ground contact 402 shown in FIG. 4 is the shape of a cross, but may be shaped as a star, pin, and the like.

The ground contact 402 eliminates cross talk along the diagonal axes 412 and 414. EMF effects of the differential pair 404 on the differential pair 408, and of the differential pair 408 on the differential pair 404 are eliminated by the ground contact 402. Likewise, EMF effects of the differential pair 406 on the differential pair 410, and of the differential pair 410 on the differential pair 406 are eliminated by the ground contact 402. The orthogonal orientation of adjacent differential pairs, e.g. 404 and 406, 406 and 408, 408 and 410, and 410 and 404, eliminate the EMF effects between adjacent differential pairs.

Figure 5:
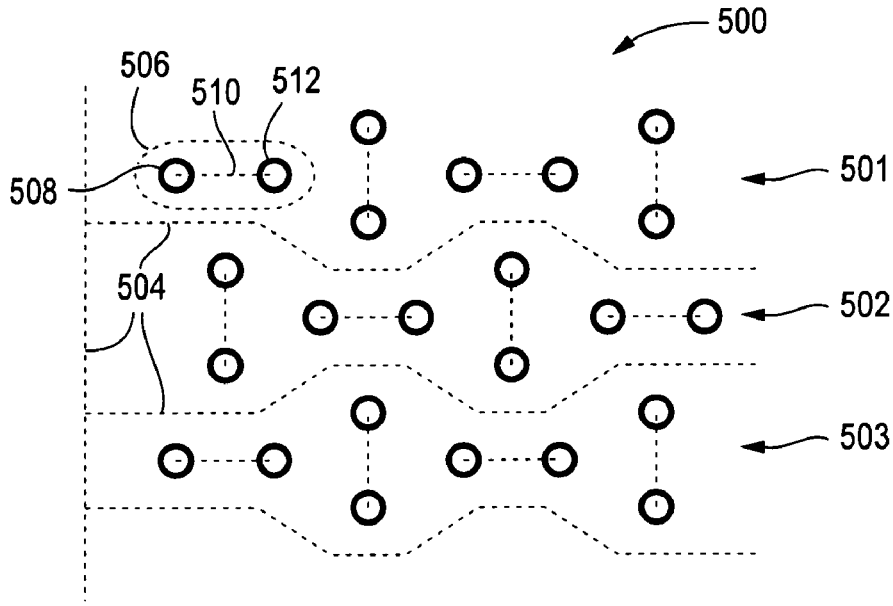
FIG. 5 is a top view of a modular grouping of differential pairs of contacts formed in accordance with an embodiment of the present invention.

FIG. 5 illustrates a top view of a modular footprint 500 of differential pairs of contacts formed in accordance with an embodiment of the present invention. A differential pair 506 is illustrated in FIG. 5 as a pair of pin type contacts 508 and 512. A contact line 510 is illustrated between contacts 508 and 512. A stepped outline 502 defines one of the modular groups of the modular footprint 500, and follows the contour of a row arrangement of the differential pairs of the row.

A physical module (also known as a chicklet module) may have the contour shape of the stepped outline 504 following a row arrangement of the differential pairs 506 of the row. Modules 501–503 are fitted and shaped to be slid into the electrical connector housing in an interlocking fashion. In an alternative embodiment, the shape of the modules 501–503 may not follow the configuration of the differential pairs, but may be of some other shape, for example a smooth planar shape.

Examples of applications for embodiments of this invention include board connectors for backplane/daughter card connectors, mezzanine style connectors, and I/O style connectors. The cross talk/noise present in the footprint of such connectors may be as low as 1 percent with data rates of 2 or 3 Gigabits per second (Gps).

Figure 6:
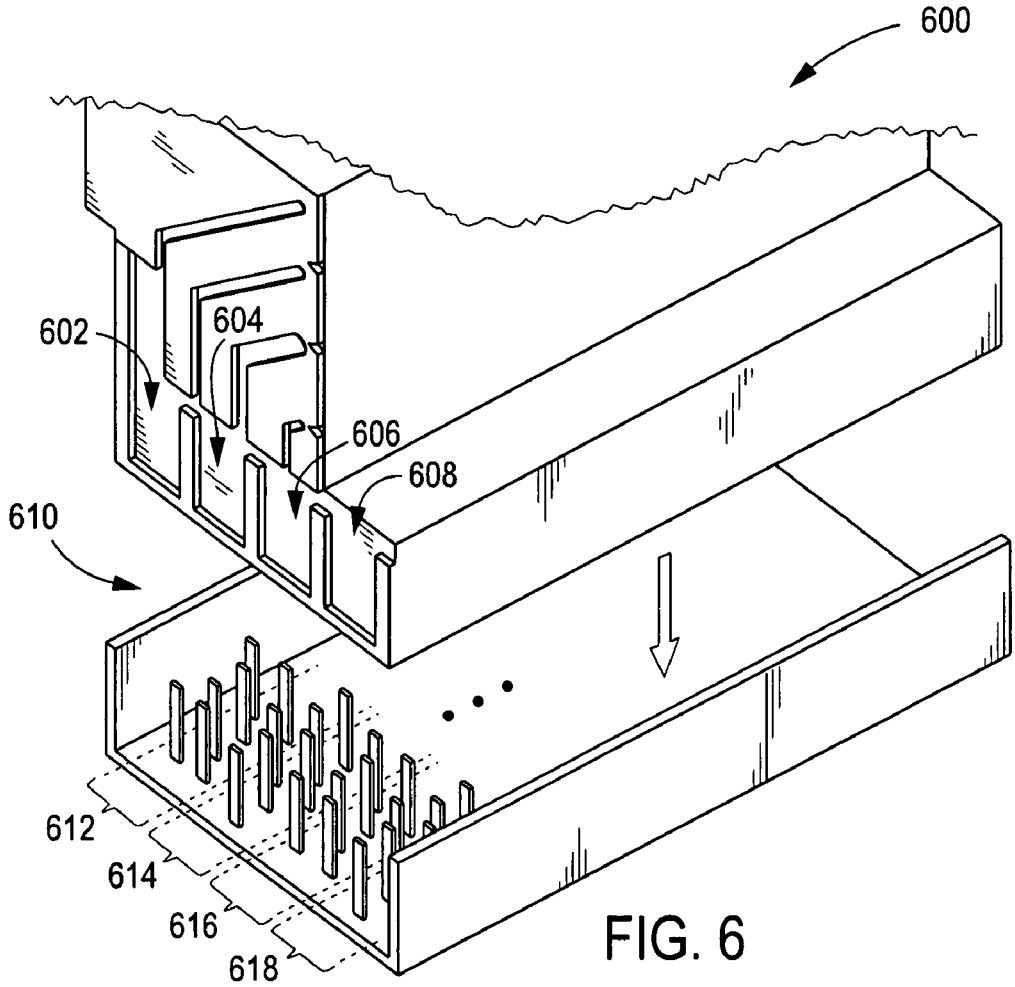
FIG. 6 is a perspective view of a connector containing a contact pattern in accordance with an embodiment of the present invention.

FIG. 6 illustrates a perspective view of an electrical connector 600 containing multiple modules 602, 604, 606, and 608 that comprise the contact pattern 10 described above at interface 610. A row 612 of differential pairs of contact blades arranged in the contact pattern 10 fit into the contact pattern 10 of sockets of the module 602. Similarly, a row 614 of connector blades arranged in the contact pattern 10 fit into the sockets of module 604, a row 616 of connector blades fit into the sockets of module 606, and a row 618 of connector blades fit into the sockets of module 608.

In one embodiment, the contact configurations described above may be included in a connector assembly of the type described in U.S. Pat. No. 6,461,202, the subject matter of which is incorporated in its entirety by reference. In yet another embodiment, the contact configurations may be included in a connector assembly of the type described in U.S. Pat. No. 6,682,368, the subject matter of which is incorporated in its entirety by reference.

While the invention has been described in terms of various specific embodiments, those skilled in the art will recognize that the invention can be practiced with modification within the spirit and scope of the claims.

What is claimed is:

1. An electrical connector, comprising:

a housing having a mating interface; and contacts provided in said housing and extending along parallel contact axes, said contacts organized in differential pairs with said contacts in each of said differential pairs being located along a differential pair contact line extending transversely between the contact axes of said contacts in said differential pair, wherein said differential pair contact lines of adjacent said differential pairs are non-parallel to one another.

2. The electrical connector of claim 1, wherein each of said differential pairs includes first and second contacts divided from one another by an associated bisector axis extending there between, said bisector axis being oriented in a non-parallel relation to said differential pair contact line, said bisector axes of adjacent said differential pairs being oriented perpendicular to one another.

3. The electrical connector of claim 1, wherein said differential pair contact lines of adjacent differential pairs are oriented perpendicular to one another.

4. The electrical connector of claim 1, wherein said differential pairs include first and second differential pairs having first and second differential pair contact lines that are arranged perpendicular to one another.

5. The electrical connector of claim 1, wherein said differential pairs are aligned in rows and columns, said differential pair contact lines of adjacent differential pairs in said rows and said columns being oriented perpendicular to one another.

6. The electrical connector of claim 1, wherein said contacts in each of said differential pairs include a bi-sector line extending therebetween and being parallel to the contact axes of said contacts in said differential pair, each said bi-sector line being coincident with said differential pair contact line of an adjacent differential pair.

7. The electrical connector of claim 1, wherein said contacts include blades at said mating interface having a height in a longitudinal direction along the contact axis, and a length and a width both in a transverse direction to the contact axis, said length being greater than said width, said blades being oriented with said transverse direction extending parallel to an associated said differential pair contact line.

8. The electrical connector of claim 1, wherein said contacts include blades at said mating interface having a height in a longitudinal direction along the contact axis, and a length and a width both in a transverse direction to the contact axis, said height being greater than said width, wherein said blades of adjacent said differential pairs are oriented perpendicular to one another.

9. The electrical connector of claim 1, further comprising a ground plane centered between a group of said differential pairs.

10. The electrical connector of claim 1, further comprising chicklet modules separately removably joined to said housing, said chicklet modules each having an insulated body holding a row of said differential pairs of said contacts.

11. The electrical connector of claim 1, further comprising a printed circuit board held in said housing, said contacts electrically joining traces on said printed circuit board.

12. The electrical connector of claim 1, wherein said contacts are configured to convey high speed differential signals at data rates of at least 2 Gigabits per second.

13. The electrical connector of claim 1, wherein said housing includes first and second mating interfaces arranged in a non-parallel relation to one another.

14. The electrical connector of claim 1, wherein said mating interface is configured to mate to one of a daughter card and a mother board.

15. An electrical connector, comprising:

a housing having a mating interface; and contacts provided in said housing and organized in differential pairs with said contacts in each of said differential pairs being located along a differential pair contact line, said differential pairs being aligned in rows and columns, wherein said differential pair contact lines of adjacent said differential pairs in said rows are non-parallel to one another, wherein said differential pair contact lines of adjacent said differential pairs in said columns are non-parallel to one another.

16. The electrical connector of claim 15, further comprising a ground contact centrally located between a group of four differential pairs.

17. The electrical connector of claim 15, wherein each of said differential pairs includes 6first and second contacts divided from one another by an associated bisector axis extending there between, said bisector axis being oriented in a non-parallel relation to said differential pair contact line, said bisector axes of adjacent said differential pairs being oriented perpendicular to one another.

18. The electrical connector of claim 15, wherein said differential pair contact lines of adjacent differential pairs are oriented perpendicular to one another.

19. The electrical connector of claim 15, wherein said differential pairs are located adjacent to one another without any intervening ground contacts.

20. The electrical connector of claim 15, wherein said contacts include blades at said mating interface having a height in a longitudinal direction and a width in a transverse direction, said height being greater than said width, said blades being oriented with said transverse direction extending parallel to an associated said differential pair contact line.

* * * * *